US007198435B2

(12) United States Patent
Dolan et al.

(10) Patent No.: US 7,198,435 B2
(45) Date of Patent: Apr. 3, 2007

(54) CONTINUOUS CHAMBER ENVIRONMENT RESISTANT RETAINING WALL BLOCK AND METHODS OF USE THEREOF

(75) Inventors: John Fitzgerald Dolan, Golden Valley, MN (US); Edward Alan Knudson, Annandale, MN (US)

(73) Assignee: New Technology Resources, Inc., Edina, MN (US)

( * ) Notice: Subject to any disclaimer, the term of this patent is extended or adjusted under 35 U.S.C. 154(b) by 83 days.

(21) Appl. No.: 11/126,546

(22) Filed: May 11, 2005

(65) Prior Publication Data

US 2005/0254906 A1 Nov. 17, 2005

Related U.S. Application Data

(60) Provisional application No. 60/569,886, filed on May 11, 2004.

(51) Int. Cl.
*E02D 29/02* (2006.01)

(52) U.S. Cl. ..... 405/284; 405/286

(58) Field of Classification Search ..... 405/262, 405/284, 286

See application file for complete search history.

(56) References Cited

U.S. PATENT DOCUMENTS

| | | | | |
|---|---|---|---|---|
| 5,044,834 | A | 9/1991 | Janopaul, Jr. | |
| 5,145,288 | A * | 9/1992 | Borcherdt | 405/284 |
| RE34,314 | E | 7/1993 | Forsberg | |
| 5,294,216 | A | 3/1994 | Sievert | |
| 5,851,088 | A * | 12/1998 | Anderson et al. | 405/284 |
| 6,050,749 | A * | 4/2000 | Khamis | 405/286 |
| 6,079,908 | A * | 6/2000 | Anderson | 405/262 |
| 6,089,792 | A * | 7/2000 | Khamis | 405/262 |
| 6,280,121 | B1 * | 8/2001 | Khamis | 405/284 |
| 6,527,483 | B1 * | 3/2003 | Agee | 405/284 |
| 6,623,213 | B1 * | 9/2003 | Maydew | 405/286 |
| 6,663,323 | B1 * | 12/2003 | Boys | 405/284 |
| 6,695,544 | B2 * | 2/2004 | Knudson et al. | 405/284 |
| 6,817,154 | B2 * | 11/2004 | Dolan et al. | 405/284 |
| 6,851,242 | B1 * | 2/2005 | Weatherston | 405/284 |
| 6,872,032 | B2 * | 3/2005 | Boys | 405/284 |
| 2004/0222222 | A1 | 11/2004 | Parnall et al. | |
| 2005/0102950 | A1 | 5/2005 | Knudson et al. | |

FOREIGN PATENT DOCUMENTS

| | | |
|---|---|---|
| EP | 0708208 | 4/1996 |
| FR | 2641296 | 7/1990 |
| JP | 2003313974 | 11/2003 |

* cited by examiner

*Primary Examiner*—Frederick L. Lagman
(74) *Attorney, Agent, or Firm*—Fredrikson & Byron, PA

(57) ABSTRACT

The present invention relates to a retaining wall block that is resistant to damage and wear caused by the environment and includes a chamber, which allows the flow of fill material to adjacent blocks below and above. The deterioration resistant block is generally a hollowed frame or shell of a deterioration resistant material that is light-weight and is configured to interlock with adjacent blocks, thereby forming a continuous chamber capable of accepting and retaining any type of filling material. The filling material provides weight, stability and security to a retaining wall constructed of such blocks.

19 Claims, 15 Drawing Sheets

CONTINUOUS CHAMBER ENVIRONMENT RESISTANT RETAINING WALL BLOCK AND METHODS OF USE THEREOF

This application claims priority from provisional application No. 60/569,886 filed May 11, 2004.

FIELD OF THE INVENTION

The present invention relates to a retaining wall block that is resistant to damage and wear caused by the environment and includes a chamber, which allows the flow of fill material to adjacent blocks below and above. The deterioration resistant block is generally a hollowed frame or shell of a deterioration resistant material that is light-weight and is configured to at least partially align with blocks positioned above and below, thereby forming a continuous chamber capable of accepting and retaining any type of filling material. The filling material provides weight, stability and security to a retaining wall constructed of such blocks.

BACKGROUND OF THE INVENTION

The use of retaining walls to protect and beatify property in all types of environmental settings is a common practice in the landscaping, construction and environmental protection fields. Walls constructed from various materials are used to outline sections of property for particular uses, such as gardens or flower beds, fencing in property lines, reduction of erosion, and to simply beautify areas of a property.

Numerous methods and materials exist for the construction of retaining walls. Such methods include the use of natural stone, poured in place concrete, masonry, landscape timbers or railroad ties. In recent years, segmental concrete retaining wall units, sometimes known as keystones, which are dry stacked (i.e., built without the use of mortar), have become a widely accepted product for the construction of retaining walls. Examples of such units are described in U.S. Pat. No. RE 34,314 (Forsberg) and in U.S. Pat. No. 5,294,216 (Sievert).

However, many of the materials utilized in the construction of retaining walls are susceptible to deterioration and/or are not very aesthetically appealing. The ability of these retaining walls to withstand sunlight, wind, water, general erosion and other environmental elements is a problem with most retaining wall products.

A particular concern is the utilization of erosion protection materials in water shorelines. Leaving the shoreline natural can lead to erosion, cause an unmanageable and unusable shoreline, create high maintenance, and inhibit an aesthetically pleasing property. Many materials utilized in retention of shorelines are subject to immediate deterioration and/or are not as aesthetically appealing as one would desire. Furthermore, many materials utilized on shoreline structures are difficult to maintain due to the awkward location in the water and also the prevalent growth and presence of organic materials that can get caught and flourish in such a structure. For example, many lakeshore or ocean side properties utilize riprap as a retention device for prevention of erosion. Riprap is a configuration of large to medium size stones placed along the shoreline. A problem with waterfront properties that use a continuous wall of typical riprap is the shoreline will retain some organic material or will accumulate additional organic material brought in by the water. This usually leads to an unmanageable and aesthetically displeasing shoreline or higher maintenance. Furthermore, the riprap is never uniform in color and size and therefore does not as provide the most aesthetically pleasing shoreline or complete coverage of the shoreline. The lack of uniform shoreline coverage allows for some erosion, collection of various materials and the growth of weeds.

Another problem with materials normally utilized in the construction of retaining walls, such as poured in place concrete, masonry, landscape timbers, railroad ties or keystones is that regulations in most states and counties prohibit their use in or near bodies of water because of the crumbling or deterioration of the material into the body of water over time or the leaching of chemicals from the materials into the body of water. Many of these retaining wall materials dissolve, crumble, break apart and/or float into the body of water for which they line causing problems with the shoreline and pollution of the water. For example, the average life of various types of concrete block or keystone in water is approximately a couple of years. A need exists for a retaining wall, which would be resistant to such deterioration.

An additional concern that exists in the construction of retaining walls is the weight of the materials. Concrete blocks, large or medium size stones, timbers or keystones can be heavy and cumbersome to move into the wall location and maneuver when constructing the wall. Many locations for which retaining walls are constructed are positioned in awkward terrain. Heavy building materials are difficult to move into the location and furthermore are difficult to position when constructing the retaining wall thereby adding additional cost and labor for installation. However, the heavy materials are needed once the wall is constructed to provide stability and security to the structure. Therefore, the easy to install light-weight units used for the construction of a retaining wall, which can be weighted once placed into position thus retaining the block in position and stabilizing the completed retaining wall, would be beneficial to construction of such structures.

SUMMARY OF THE INVENTION

The present invention relates to a retaining wall block that is resistant to damage and wear caused by the environment and includes a chamber, which allows the flow of fill material to adjacent blocks below and above. The deterioration resistant block is generally a hollowed frame or shell of a deterioration resistant material that is light-weight and is configured to interlock with adjacent blocks, thereby forming a continuous chamber capable of accepting and retaining any type of filling material. The filling material provides density and stability to the retaining wall block and also ultimately provides stability and security to the retaining wall constructed of such blocks.

Various embodiments of the deterioration resistant block of the present invention comprise a front panel, back panel and two or more side panels, which adjoin the front panel and back panel thereby forming a block having a continuous flow chamber. In various embodiments at least two of the side panels extend from the front panel to the back panel at angles (e.g. less than 90°), thereby allowing for a back panel that is of shorter length than the front panel. The continuous flow chamber of each block generally forms a series of integrated channels which allow the flow of fill material from various blocks when such blocks are positioned in a retaining wall. The blocks of the present invention may further include one or more anchoring devices for securing each block to adjacent blocks or securing them into position in the retaining wall. In various embodiments of the present invention one or more of the panels include one or more aprons for interconnecting the stacked blocks. The aprons assist in positioning and/or adjoining adjacent blocks and facilitating the flow of fill material to the adjacent blocks. Additionally, the aprons assist in retaining the fill material within the adjoined blocks and also may lock the adjacent blocks to each other. As previously suggested, the chambers are adapted for receiving and retaining fill materials, such as sand, dirt, gravel, pea rock, concrete or any other similar material, which provides the permanent weighting and stability of the retaining wall block.

In additional embodiments of the present invention, the blocks may comprise two or more separated panels that are adjoined by a securing mechanism, such as a "T-hook and T-slot", or a "peg and socket system". For example, the front panel, side panels and back panel may be separated panels that are secured together to form the blocks of the present invention. These embodiments provide the benefits of providing two or more substantially flat panels and/or nestable panels that may be assembled to form the block. Also, such a process may open other beneficial manufacturing techniques to form such panels, such as extrusion. Such embodiments will also generally provide benefits related to transportation and storage.

Embodiments the deterioration resistant retaining block of the present invention may be used in constructing retaining walls on a number of property terrains, such as along waterfront properties. The deterioration resistant blocks are particularly useful for terrains near water or underwater due to their resistance to degradation. However, the deterioration resistant blocks could also be used for land applications for those that want a light-weight retaining wall block that can be filled on-site to add weight and stability and doesn't require heavy equipment for moving. Therefore, the deterioration resistant retaining wall block could be utilized to construct any form of wall or fence structure.

One unique feature of the present invention is the light-weight characteristic of the block before it is filled. As previously mentioned, embodiments of the present invention can be waterproof and may be filled with any type of fill material located at the site, such as rocks (e.g. crushed rock and pea rock), sand, gravel, soil, concrete or similar materials. The filling characteristic of the deterioration resistant block means that when the block is not filled it is very light-weight. The light-weight feature provides individuals constructing such walls the advantage of easily moving large numbers of the blocks to the site of construction with relative ease. Furthermore, the lightweight characteristic of the blocks allows for easy maneuvering of the blocks into final position when constructing a retaining wall or revetment and still allows for the stability found in heavy blocks after they are filled. These characteristics are met by the block being made of a lightweight material, such as plastic, and by it also being configured to receive a heavy fill material once it has been placed in its final position on the retaining wall.

Individuals would be more inclined to install block made of a deterioration resistant material themselves rather than cement block, timbers, dry cement process block (e.g. Keystone® or Anchor® block) and the like, because of the ease of installation, due to the lightweight material and also the longevity of the block. The weight of most regular retaining wall block is approximately 30–120 lbs, whereas embodiments of the present invention may be approximately 0.1–10 lbs. Of course, weight may vary depending on the size and materials utilized in manufacturing embodiments of the present invention. Also, as previously mentioned the blocks of the present invention achieve stability and weight by filling the block with an appropriate fill material either prior to or after it has been permanently installed.

Embodiments of the present invention further fills an unmet landscaping need for shorelines in that the deterioration resistant blocks are easily manufactured. Examples of possible manufacturing methods include but are not limited to injection-molding, extrusion, roto-molding and blow-molding. Also any high volume application for production may be utilized in manufacturing the present invention. The individual units are light-weight, aesthetically pleasing, easy to install, prevent shoreline and other terrain erosion and compliment existing retaining wall block. Various embodiments of the deterioration resistant blocks of the present invention are also waterproof, can withstand ice damage due to their flexible nature and are easily replaced or repaired in case of damage. Furthermore, they are rugged and require very low maintenance. Additionally, embodiments of the present invention are easily transportable and storable due to their light-weight and possible stacking and/or nesting features.

As previously suggested, embodiments of the present invention are also resistant to deterioration, such as wear, discoloration, crumbling and breaking. Therefore, the deterioration resistant block does not have to be replaced as often and/or increases the lifespan of the retaining wall. Due to these characteristics, the blocks of the present invention generally have a much greater lifespan than the life of a regular dry cast concrete type block or timber. The increased lifespan of the block translates to fewer or no occurrences of replacement of individual blocks or the potential complete reconstruction of the entire wall. Furthermore, retaining wall materials, such as concrete block formed by the dry cast process, (e.g. Keystone® blocks) and timbers are typically not used in water applications because they dissolve, crumble and/or break down over time and exposure. The durability and resistant characteristics of the present invention reduce and prevent this deterioration, therefore making it very beneficial for all applications that come in contact with water.

Another consideration relating to the water application of embodiments of the retaining wall block of the present invention is the block's resistance to ice damage when installed around a body of water when it freezes. When ice expands and/or moves it shifts, tears and damages various types materials utilized for shoreline retention, such as concrete block formed by the dry cast process, rip rap, landscape timbers or anything rigid. Embodiments of the present invention can be manufactured with a material that has flexibility, such as non linear low density polyethylene, that may be designed to flex in a similar way as a Rubbermaid® trash container. Considering that the deterioration resistant block would be filled with a fill material, the deformation would be minimal, but still enough to prevent damage to the retaining wall block and/or the entire wall. Furthermore, upon melting or shifting of the ice the deterioration resistant block would return to its original configuration.

Another advantage of embodiments of the present invention relates to the high cost of waterfront property and people's inclination to improve their property to keep it well-maintained and aesthetically pleasing. As previously mentioned riprap, is commonly stacked along property shorelines to prevent erosion. The trouble with this shoreline preservation application is that the rock leaves many crevices for organic material to reside and, since it is close to water, the crevices are prominent areas for the growth of vegetation. One advantage of embodiments of the present invention is that they are designed to fit next to each other, which reduces the amount of organic material lodging between the blocks, thereby preventing vegetation from growing in such structures.

In addition, many waterfront properties suffer water damage when water levels rise above the shoreline. The retaining wall block of the present invention is a solution to water retention and erosion problems in such areas of threatening high or rising water levels. Furthermore, the retaining wall block poses a solution in locations where there is a flood plane or areas that are washed out by any type of water movement. Sandbags have been a solution to such problems, but are not a permanent or aesthetically pleasing solution. The retaining wall block can replace sand bags in an area for which a more permanent and aesthetically pleasing alternative is desired.

As previously suggested, the deterioration resistant retaining wall block can comprise any type of shape, configuration, color and design. In addition the retaining wall block may include any design or color located anywhere on any panel or wall of the block. Furthermore, the utilization of conventional type materials for retaining walls, such as concrete blocks, timbers or keystones, are heavy to install and do not provide long term or permanent solutions, due to the previously mentioned deterioration problems. Therefore, the present invention provides an aesthetically pleasing solution and replacement for materials, including sandbags, concrete, mortar block, or rip rap, presently utilized in retaining wall construction.

BRIEF DESCRIPTION OF THE DRAWINGS

FIG. 4*c* is a perspective view of a plurality of pegs including panel slots adjacent to a front panel and side panel that include T-hooks.

DETAILED DESCRIPTION OF THE INVENTION

The embodiments of the present invention described below are not intended to be exhaustive or to limit the invention to the precise forms disclosed in the following detailed description. Rather, the embodiments are chosen and described so that others skilled in the art can appreciate and understand the principles and practices of the present invention.

Figure 1A:
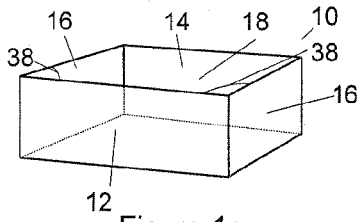
FIG. 1*a* is a perspective view of one embodiment of a deterioration resistant retaining wall block.

FIG. 1*a* depicts one embodiment of the deterioration resistant retaining wall block 10 comprising a front panel 12, a back panel 14 and one or more side panels 16. The side panels 16 of this embodiment operably join the front panel 12 and back panel 14 to form a retaining wall block 10 having a continuous flow chamber 18. The continuous flow chamber 18 is positioned within the front panel 12, back panel 14 and side panels 16.

It is noted that various embodiments of the retaining wall block of the present invention include no top panel or a partial top panel and no bottom panel or a partial bottom panel, thereby providing an open top and bottom to allow for the substantially uninhibited flow and/or commingling of fill material from one block to adjacent blocks above and/or below in the continuous flow chambers when such blocks are operably adjoined or positioned in proximity to each other. In other embodiments, the bottom panel may include one or more apertures to allow for at least a partial alignment of openings, thereby allowing the flow and commingling of fill material from one block to blocks positioned above and/or below.

Figure 1B:
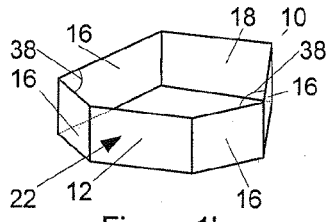
FIG. 1*b* is a perspective view of another embodiment of a deterioration resistant retaining wall block.

In an alternate embodiment, as depicted in FIG. 1*b*, the retaining wall block 10 may comprise a beveled front that includes one or more bends, slants or creases in the front panel 12. FIG. 1*b* depicts one embodiment of the retaining wall block of the present invention, wherein the front panel 12 is beveled thereby taking on a tri-panel appearance. It is noted that the front panel 12 may also be rounded rather than beveled to provide a more natural appearance. Similar to the embodiment depicted in FIG. 1*a*, the open top and bottom of each retaining wall block 10 that includes the beveled front panel 12 also allows for the receiving of fill material that may flow through the block 10 and commingle with the fill material in one or more adjacent blocks positioned above and below.

Figure 2A:
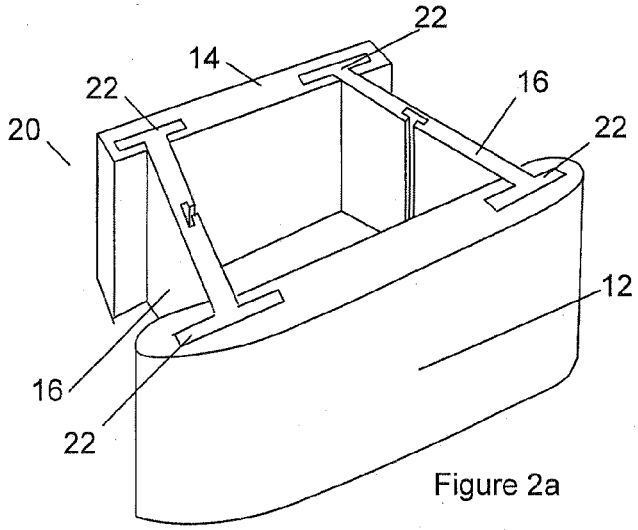
FIG. 2*a* is a perspective view of an embodiment of a deterioration resistant retaining wall panel block including a T-hook and T-slot securing mechanism.
Figure 2B:
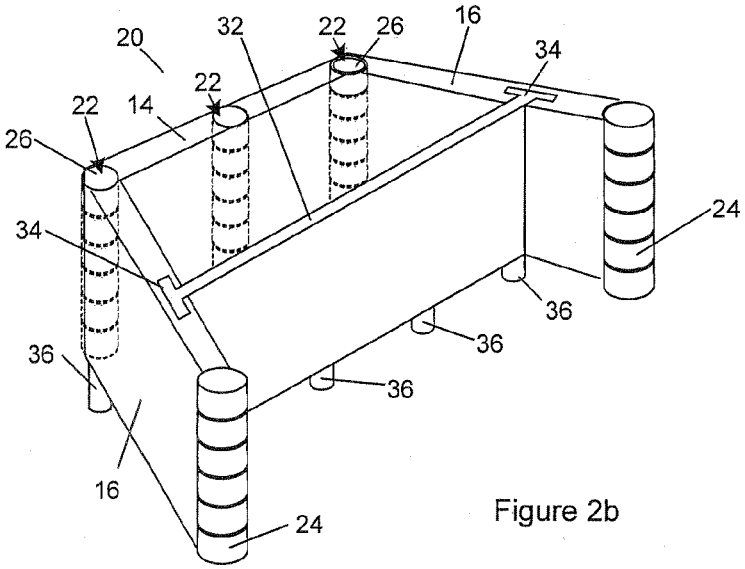
FIG. 2*b* is a perspective view of an embodiment of a deterioration resistant retaining wall panel block having no front panel and including a peg and socket securing mechanism.
Figure 2C:
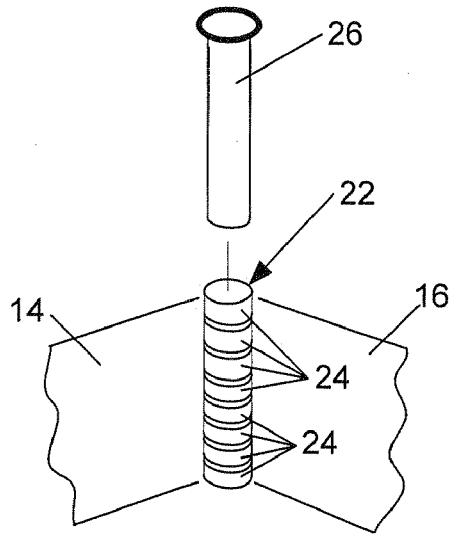
FIG. 2*c* is an exploded view of an embodiment of a corner of a deterioration resistant retaining wall panel block having a peg and socket securing mechanism.

Other embodiments of the present invention, as depicted in FIGS. 2*a*–2*c* include retaining wall blocks in a panel block design. Similar to the retaining blocks of FIGS. 1*a* and 1*b*, the panel blocks of the present invention generally comprise a front panel 12, a back panel 14 and one or more side panels 16. However, rather than an integral joining of all panels, the panel blocks 20 include two or more separated panels that are operably connected with one or more securing mechanisms 22 to join the two or more panels, thereby forming the block 20. In other embodiments the panel blocks 20 require securing mechanisms 22 to join three or more panels to form the panel block 22. Also, in still other embodiments, the panel block 20 of the present invention requires securing mechanisms 22 to join four or more separated panels to form the panel block 20. In many of these embodiments, the side panels 16 are operably joined to the front panel 12 and back panel 14 with two or more securing mechanisms 22 to form a continuous flow chamber 18 within the panel block 20. Similar to the retaining wall blocks 10 described above, the continuous flow chamber 18 of the panel block is positioned within the front panel 12, back panel 14 and side panels 16.

In other embodiments, the panel block 20 may also include a front panel 12 that is beveled (e.g. beveled to take on a tri-panel appearance). It is noted that the front panel 12 of the panel block 20 may also be rounded or provided in other shapes rather than beveled as depicted in FIGS. 2*a* and 2*b*.

Figure 3A:
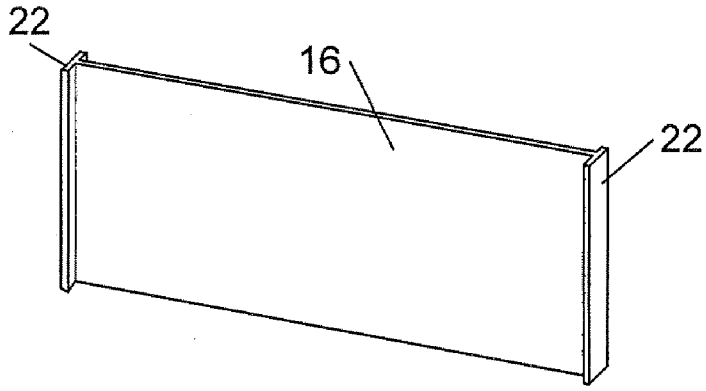
FIG. 3*a* is a perspective view of a front, side or back panel that includes a T-hook and T-slot securing mechanism.

As previously mentioned, the panel blocks 20 generally include one or more securing mechanisms 22 that provide a sufficient means for securing the separated panels to each other. A sufficient means is generally one wherein the panels will not release when the force of the fill material is applied to the panels 12,14,16 of the panel block 20. FIG. 3*a* depicts one side panel 16 that includes part of a securing mechanism 22 that may be utilized to form a panel block 20 similar to that depicted in FIG. 2*a*. It is noted that the panel or variations thereof, depicted in FIG. 3*a*, could also be utilized as a front panel 12 or back panel 14. The securing mechanism 22 of some embodiments includes a T-hook positioned at one or more ends of the panel 16 that fits securely into a T-slot positioned on an adjacent panel 12, 14, or 16. By inserting a T-hook into a T-slot, one corner of a panel block 20 is thereby formed.

Figure 3B:
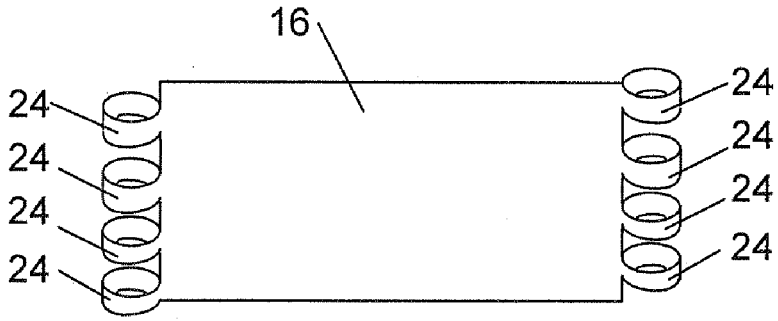
FIG. 3*b* is a front view of a front, side or back panel that includes a plurality of threads that are part of a peg and socket securing mechanism.

In another embodiment, as depicted in FIG. 3*b*, the panel 16 includes a securing mechanism 22 including a series of threads 24 that are part of a peg and socket system. It is noted that the panel 16 depicted in FIG. 3*b* could also be utilized as a front panel 12 or back panel 14. FIG. 2*b* depicts one embodiment of the panel block 20 of present invention before the attachment of a front panel (not shown) wherein the side panels 16 are operably joined to the back panel utilizing a securing mechanism 22 that is one embodiment of a peg and socket system. In operation the panels 12, 14 and 16 are positioned so that threads 24 of each adjacent panel intertwine, thereby forming a slot that a peg or pin 26 can be inserted to secure the panels 12,14,16. An exploded view of the securing mechanism 22 of this embodiment is depicted in FIG. 2*c*. In this embodiment, the insertion of the pegs or pins 26 into the threaded sockets 24 secures the front panel 12, back panel 14 and the side panels 16 together in a manner similar to a door hinge. It is noted that other peg and socket systems may be utilized to secure the panels when forming the panel blocks 20 of the present invention.

Figure 2D:
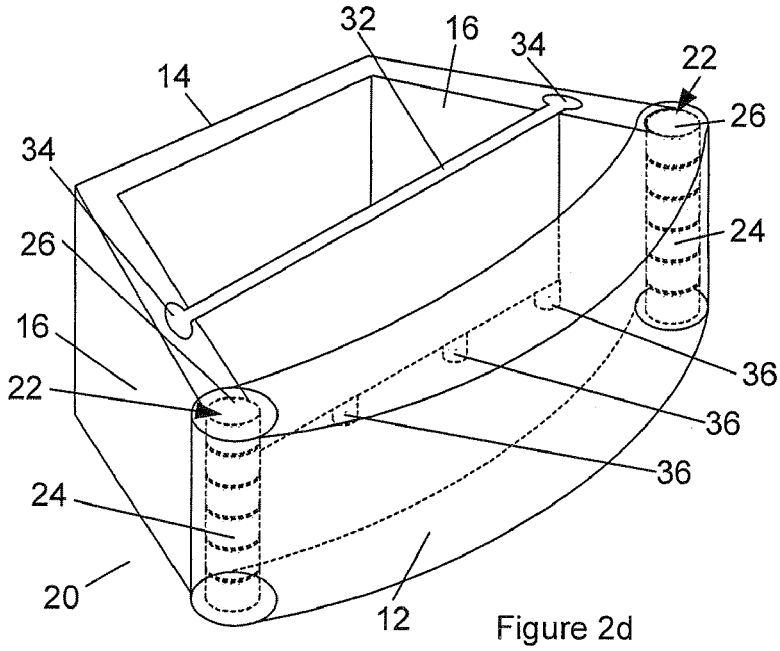
FIG. 2*d* is a perspective view of an embodiment of a deterioration resistant retaining wall panel block including a peg and socket securing mechanism and integral back and side panels.

FIG. 2*d* depicts another embodiment of the panel block 20 of the present invention wherein the block 20 includes side panels 16 and a back panel 14 that are formed or manufactured in a single part, thereby foregoing the need for one or more securing mechanisms to secure the side panels 16 with the back panel 14. Such an embodiment has benefits in providing for additional stability of the block structure and the ability to manufacture the entire block 20 in a limited number of parts (e.g. two part system; a side/back panel and a front panel). Such embodiments allow for the side and back panels 14, 16 to be formed in a single part by processes that have manufacturing benefits, such as extrusion or thermoforming. Once the single side/back panel 14,16 is provided, it may be adjoined to a molded and/or fabricated front panel 12 by securing the pieces together with one or more securing mechanisms 22.

Figure 4A:
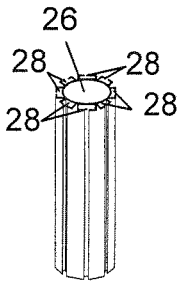
FIG. 4*a* is a perspective view of a peg including a plurality of panel slots.
Figure 4B:
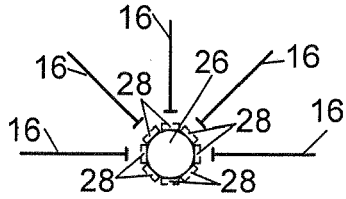
FIG. 4*b* is a top view of the peg of FIG. 4*a* and also a plurality of partial T-slot panels.
Figure 4C:
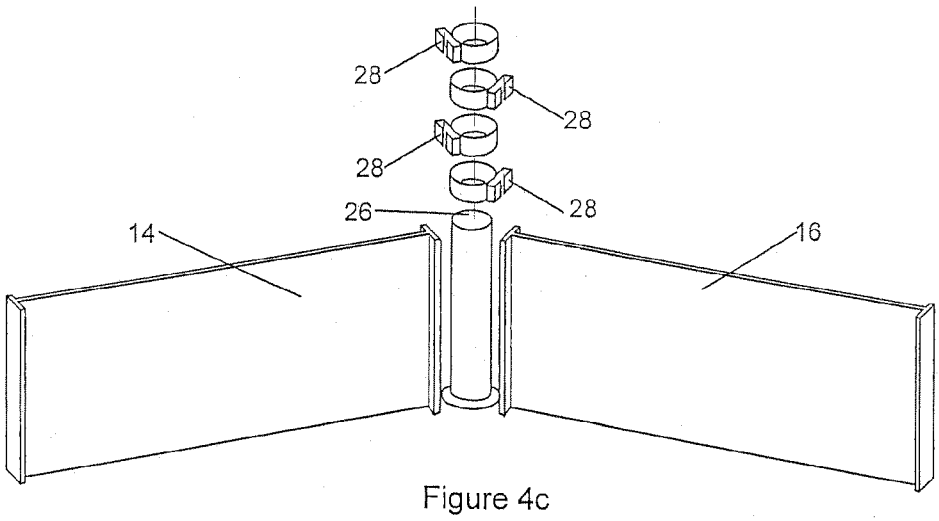
FIG. 4*c* is a perspective view of a peg and a plurality of panel slots adjacent to a front panel and side panel that include T-hooks.
Figure 4D:
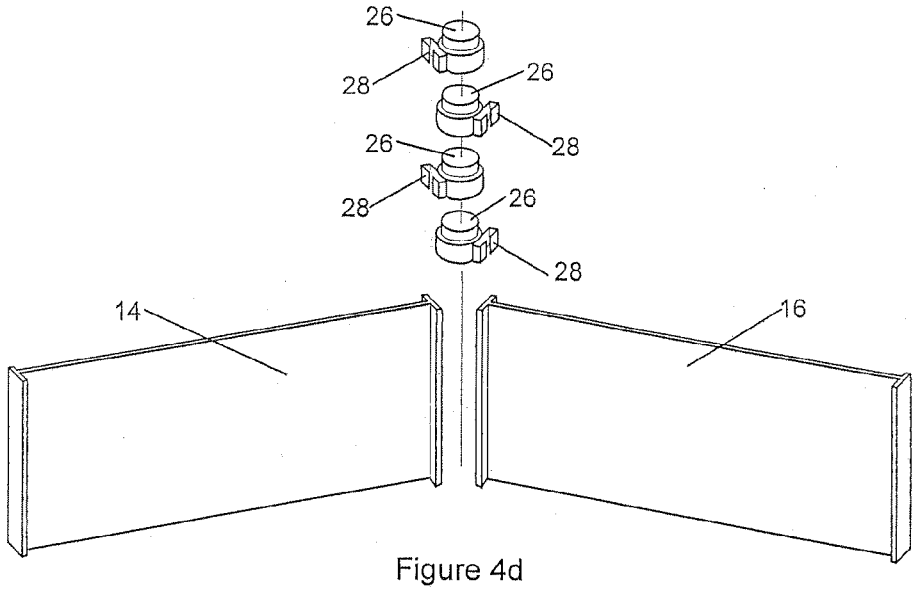

In yet another embodiment of the present invention a securing mechanism 22 may be provided as a hybrid of the T-hook and T-slot system and the peg and socket system. In such embodiments a peg 26 including a plurality of panel slots 28, as depicted in FIG. 4*a*, may be positioned to receive and secure two or more panels to form one or more corners of a panel block 20. Examples of some peg and panel systems are depicted in FIG. 4*b*–4*d*.

Figure 3C:
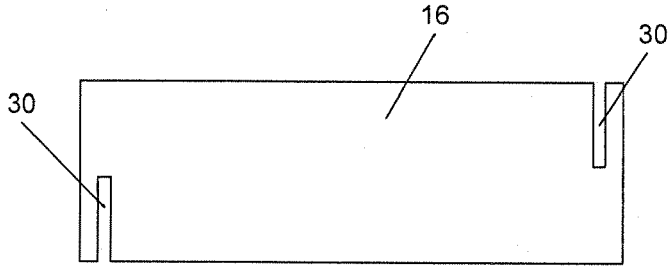
FIG. 3*c* is a front view of a front, side or back panel that includes a slot securing mechanism.

In still another panel block embodiment, the panels may include two or more slits to accommodate the securing of various panels together. FIG. 3*c* depicts a side panel 16 of the present invention that includes a pair of slits 30, one opening upward and one opening downward. It is noted that the embodiment depicted in FIG. 3*c* and variations thereof could also be utilized as a front panel 12 and/or back panel 14. In operation the slit 30 of a panel with a downward opening slit is inserted into the slit 30 of a panel having an upward opening slit. The nesting of the slits of the two panels forms a corner of one embodiment of the panel block 20 of the present invention. The remaining panels may then be joined in a similar fashion or with an alternative securing mechanism (not shown) to form the continuous chamber and a panel block embodiment.

FIGS. 2*b* and 2*d* also depict embodiments of a panel block 20 of the present invention that include a stabilizing partition 32. The stabilizing partition may be included in the retaining wall block 10 or panel block 20 to further stabilize the block structure, take pressure off of the front panel caused by the packed fill material and also provide a divider so that different fill materials may be added to the same block 10, 20 (e.g. a packing material toward the back of the block and a planting fill material in the front of the block). In various embodiments the stabilizing partition 32 may take a form similar to a side panel or back panel that includes attachment members 34 (e.g. T-hooks, pegs . . . ) positioned on the ends to act as part of the securing mechanisms 22. In some embodiments the partition 32 may include peg extensions 36 that operate as a block positioning and securing means when constructing a retaining wall. The peg extensions 36 may be placed anywhere on the partition including the ends and/or dispersed along the bottom edge of the partition 32. In construction of a wall, the peg extensions 36 may butt up against one or more partitions present in blocks positioned below, thereby holding the block 20 in position and providing an indication of proper positioning of the block 20. It is noted that the peg extensions 36 may be included on the back panel 16 rather than or in addition to the partition 32 so as to butt up against the back panel of the blocks positioned below. Such peg extensions may be utilized in integral blocks 10 (blocks with no securing mechanisms) or panel blocks 20.

Figure 5:
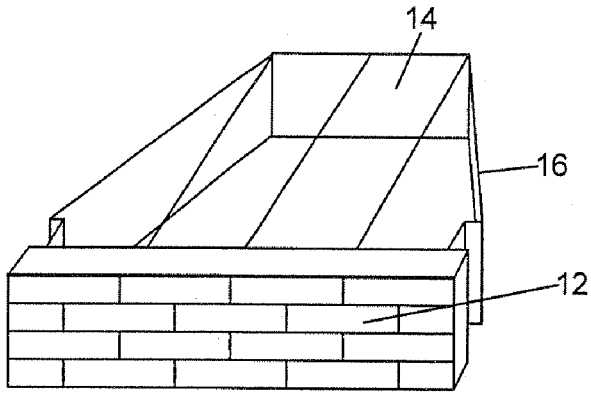
FIG. 5 is a perspective view of one embodiment of a block of the present invention that includes a molded or fabricated front panel displaying a plurality of block or brick.

In the blocks of the present invention, including the panel blocks 20, the front panel 12 will generally include a molded and/or fabricated texture and/or pattern in the deterioration resistant material that is visible to an observer. In various embodiments of the present invention the exposed surface of the front panel 12 will have a natural earthen appearance simulating the texture and color of natural earthen surfaces. For example, the exposed surface of the front panel 12 may be textured and colored to have the appearance of rock, stone, sand, soil, clay, wood, trees and foliage, water, or any other natural earthen appearance. Additionally, in other embodiments, the exposed surface of the front panel 12 may further include one or more designs (e.g. symbols, company names, logos, images) that may be positioned in the natural earthen appearance texture and color (e.g. a company logo embedded in a stone color and texture). Also, in other embodiments of the present invention, the front panel 12, as depicted in the FIG. 5, may further include a design, such as the appearance of multiple bricks, stones, or blocks. This allows for the installation of larger blocks in a wall that appears to include a multitude of bricks, stones or blocks.

As previously indicated the blocks 10, 20 of the present invention generally include one or more side panels 14 that engage and extend from the front panel 12 back to engage with a back panel 16. As depicted generally in FIGS. 1*a*, 1*b* and 2*a*–2*c*, in some embodiments of the present invention, the side panels 14 engage the front panel 12 at angles to provide for a tapering of the block as it moves back in width. The angle 38 formed between the front panel 12 and side panel 14 is generally less that 90° when the front panel 12 is substantially straight and less than 150° when the front panel 12 is rounded or beveled. In other embodiments, the angle 38 is between about 45° and 85° for substantially straight front panels 12 and between 60° and 120° for beveled and rounded front panels 12. In various embodiments the side panels 14 may extend from the front panel 12 at angles that would allow them to engage each other at the back of the block, thereby forming the back panel 16 and chamber 18 by their engagement (e.g. a triangle or diamond configuration). Finally, in various embodiments, the top edge of the side panels 14 may slightly slope down from front to back, thereby providing a back end of the block that is slightly lower than the front of the block (e.g. 0.5–10 mm).

Figure 6A:
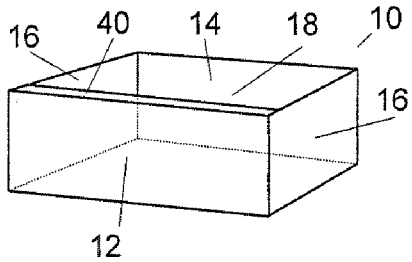
FIG. 6*a* is a perspective view of one embodiment of a deterioration resistant retaining wall block with a partial top panel.
Figure 6B:
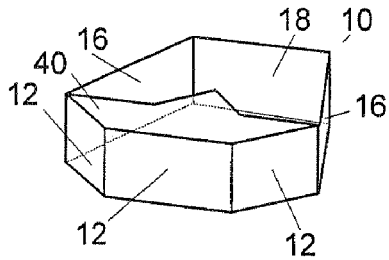
FIG. 6*b* is a perspective view of another embodiment of a deterioration resistant retaining wall block with a partial top panel.
Figure 7A:
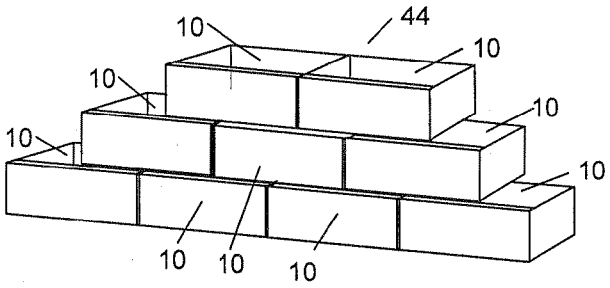
FIG. 7*a* is a perspective view of a staggered row retaining wall that includes deterioration resistant retaining wall blocks having a flat front panel.
Figure 7B:
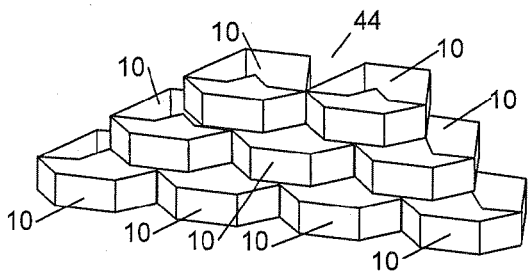
FIG. 7*b* is a perspective view of a staggered row retaining wall that includes deterioration resistant retaining wall blocks having a beveled front panel.

In other embodiments, as illustrated in FIGS. 6*a* and 6*b*, the retaining wall block 10 further includes an optional partial top panel 40 that is exposed when a retaining wall is constructed. The partial top panel 40 assists to close or partially close the top front portion of the block 10, 20 that may be exposed to the outer environment. In the embodiment depicted in FIG. 6*b*, the top panel 40 further includes a protrusion 42, which is intended to fill the void created by the beveled front panel 12 when constructing a retaining wall that includes staggered rows of such blocks 10. See FIGS. 7*a* and 7*b* for a depiction of a perspective view of a retaining wall 44 including staggered rows. In various embodiments, the blocks 10, 20 include a partial top panel 40 that extends from the front panel 12 back to no more than 75% of the width of the block. It is noted that block width is measured from the front panel 12 to the back panel 14 of the block. In other embodiments of the present invention, such a partial top panel extends from the front panel no more than 50% of the width of the block. In yet other embodiments the partial top panel 20 extends from the front panel no more than 35% of the width of the block. Such a partial top panel 40 provides for at least a partial sealing of the block at the top front portion, of which may be exposed when the retaining wall is constructed in a configuration wherein the wall inclines back toward the surface or slope intended to be protected. It is noted that in various embodiments the top panel 40 may further include one or more planting apertures 46 that may allow plant growth from the top surface of the block. As previously suggested, the open top and bottom of each retaining wall block 10, 20 allows for the receiving and commingling of fill material that may flow from and through the block 10, 20 to one or more adjacent blocks 10, 20 below.

Figure 8A:
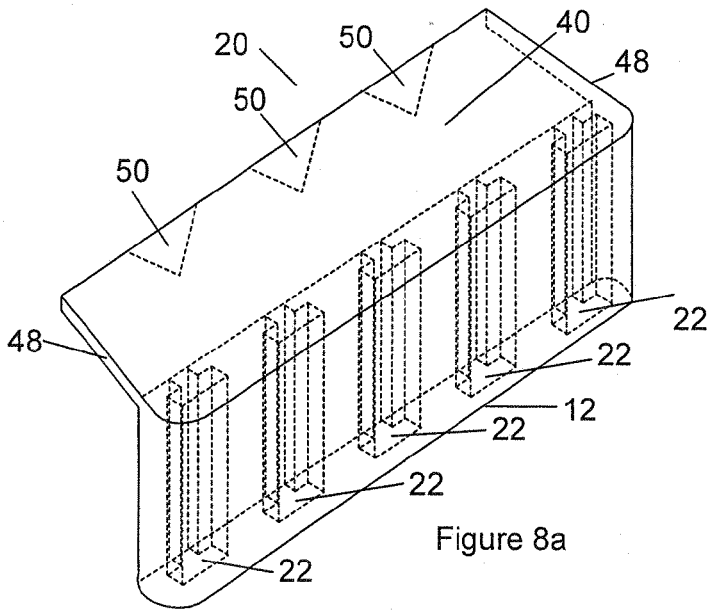
FIG. 8*a* is a perspective view of one embodiment of a front panel including a partial top panel.
Figure 8B:
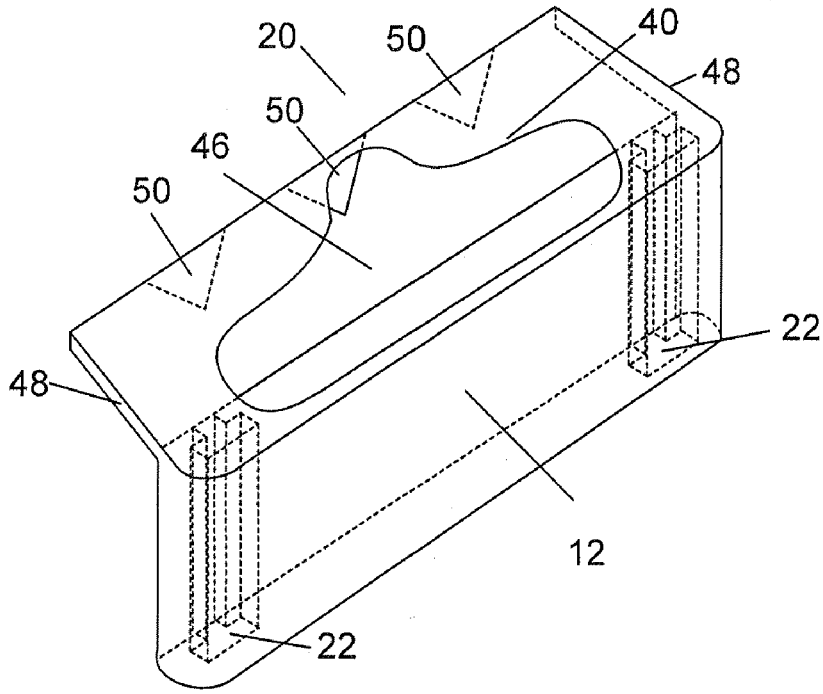
FIG. 8*b* is a perspective view of one embodiment of a front panel including a partial top panel with a planting aperture.

A partial top panel 40 may also be incorporated into embodiments of the front panel 12 utilized in embodiments of the panel blocks 20 of the present invention. FIG. 8*a* depicts a front panel 12 of a panel block 20 wherein the partial top panel 40 extends back from the front edge of the panel block 20. The partial top panel 40 of this embodiment further includes optional top side panels 48 that extend downward from the partial top panel 40 and may extend over or within the side panels 16 of the panel block (not shown). The partial top panel 40 of FIG. 8*a* further includes one or more cover tabs 50 to assist in securing the top panel 40 into the fill material or over a partition (not shown). The partial top panel 40 may also include one or more planting apertures 46, as depicted in FIG. 8*b*, that allows for the growth of plants from the top of the panel blocks 20. Also, various embodiments may also include more than two securing mechanisms 22 as depicted in FIG. 8*a*. This is advantageous if partial blocks are required, as will be explained further below. By providing additional securing mechanisms 22, the cutting of the front panel 12 still allows for the remaining portion of the front panel 12 to have two outer securing mechanisms 22 for securing a side panel to the cut front panel. Partial blocks may further include one or more shorter stabilizing partitions (not shown) to assist in securing the two halves of the block together after cutting and provide addition stability to the partial block.

Figure 9A:
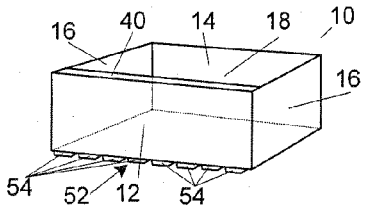
FIG. 9*a* is a perspective view of an embodiment of a deterioration resistant retaining wall block, which includes a securing apron and a partial top panel.
Figure 9B:
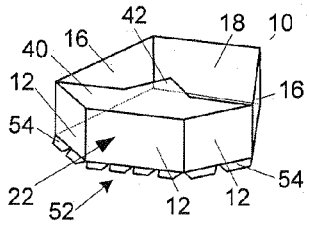
FIG. 9*b* is a perspective view of another embodiment of a deterioration resistant retaining wall block, which includes a securing apron and a partial top panel.

FIGS. 9*a* and 9*b* depict a front perspective view of two embodiments of the present invention wherein the retaining wall block 10 of the present invention further includes one or more anchoring devices for securing each block to adjacent blocks or securing them into position in the retaining wall. Generally the anchoring devices may be adjoined, rested within or inserted into the top panel 12, back panel 14 and/or side panels 16. For example, as depicted in FIGS. 9*a* and 9*b* the anchoring devices include one or more securing aprons 52 adjoined to the front panel 12, side panels 14 and/or back panels for interconnecting the stacked blocks 10 and assisting the flow of fill material within the continuous chambers 18 of the blocks. As depicted in FIGS. 9*a* and 9*b*, the aprons 52 may include a plurality of teeth 54 that extend downward from one or more of the various panels 12, 14, 16 into the adjacent blocks 10 below, thereby adjoining the blocks 10 and formulating the continuous chamber system. The aprons 52 generally secure the block into place and inhibit leakage of the fill material when it is poured into and retained within the chambers 18. The teeth 54 of the present invention allow for indentations between the teeth 54 that may accommodate the side panels 16 of adjacent blocks 10 below. The indentations further provide for a secure and flush fit of the adjoining blocks 10. Also, it is noted that individual teeth may be removed or cut away to further assist the proper fit of blocks in the wall.

Figure 9C:
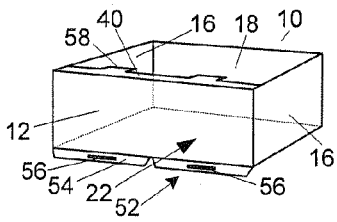
FIG. 9*c* is a perspective view of another embodiment of a deterioration resistant retaining wall block, which includes a securing apron that has interlocking slots.

In another embodiment of the present invention, as depicted in FIG. 9*c*, the aprons 52 include one or more slots 56 configured to accept one or more interlocking members 58, which are positioned on the top panel 400. The interlocking members 58 extend inwardly from the edge of the top panel 40 a length sufficient to pass through the slots 56 of the adjacent blocks 10 positioned above.

In an alternate embodiment of the present invention the apron 52 adjoined to the front panel 12 may extend forward. See FIGS. 10*a*–*c*. The extension of the apron 52 forward allows for a secure locking of adjacent blocks by inserting the forward extending apron 52 under the top ledge 40 of the adjacent blocks 10 below. FIG. 10*b* depicts the apron 52 offset from the front panel 12 of the block 10. In such embodiments, the apron 52 would be secured to a bottom panel (not shown). The bottom panel may be secured to the front panel 12 and side panels 16 or hingedly attached to the front panel 12. Such an offset apron 52 allows for the bottom panel to partially extend over the top panel 40, thereby further assisting in sealing the continuous chamber from the environment in front of the wall.

Figure 10A:
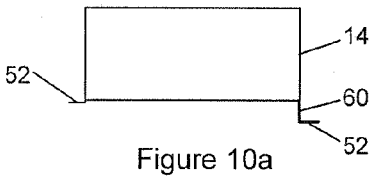
FIG. 10*a* is a side view of a deterioration resistant retaining wall block, which includes a securing apron that extends forward.
Figure 10B:
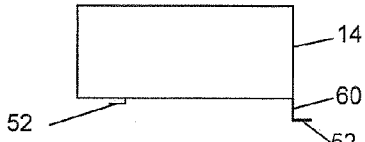
FIG. 10*b* is a side view of a deterioration resistant retaining wall block, which includes a securing apron that extends forward and is offset from the front panel.

In one embodiment of the present invention, as depicted in FIGS. 10*a* and 10*b*, an apron 52 may attached to an extension 60 of the back panel 14. The extension 60 may be adjoined to and extend along the back panel 14 in a manner that would allow it to rotate or swing inward, thereby allowing the apron 52 to engage the back panel 14 of the adjacent blocks 10 below. The extension 60 may be adjoined to the back panel 14 by any means known in the art, such as hinges (e.g. living hinge), hooks, flexible plastic portions, perforations or any other means that would allow the extension 60 to swing inward.

Figure 10C:
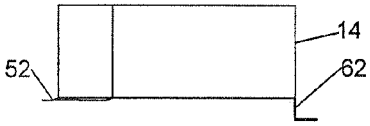
FIG. 10*c* is a side view of another embodiment of a deterioration resistant retaining wall block, which includes a securing apron that extends forward and a hooking device.

In an alternate embodiment depicted in FIG. 10*c* the back panel 14 includes one or more hooking devices 62. The hooking devices 62 are adjoined to the back panel 14 similar to the extensions 60 of FIGS. 10*a* and 10*b*. Generally, the hooking devices 62 are capable of swinging inward and engaging the back panels 14 of adjacent blocks 10 below. One or more apertures (not shown) may be positioned on the top portion of the back panel 14 to accept the hooking device 62 and thereby lock the blocks 10, 20 in place. Examples of hooking devices include but are not limited to latch hooks, clips, snaps and the like.

Figure 10D:
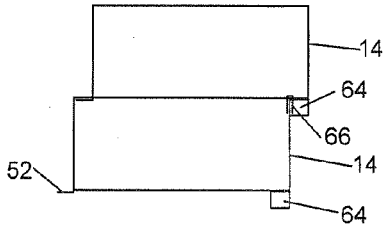
FIG. 10*d* is a side view of a deterioration resistant retaining wall block, which includes a retaining flange.
Figure 11A:
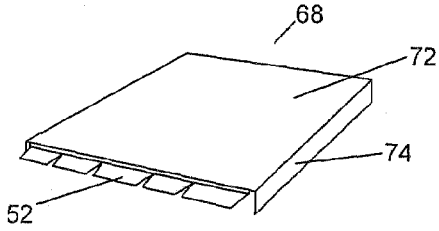
FIGS. 11*a* and 11*b* are perspective views of top cover embodiments used to cap a deterioration resistant retaining wall block.
Figure 11B:
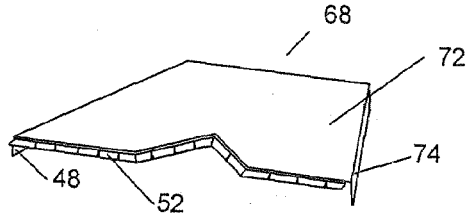

The back panel 14 may also include or be adjoined to a flange 64. FIG. 10*d* depicts the side view of an embodiment of the present invention, which includes a retaining flange 64 adjoined to the back panel 14 of the block 10, 20. On a constructed wall, each retaining flange 64 is a wall retention device that operates to inhibit outward movement of the wall. Normally, the retaining flange 64 extends downward from the back of the back panel 14 and rests against the back of the retaining block 10, 20 located below. The retaining flange 64 may be a unitary piece extending downward from the back of the retaining block 10, 20 or a series of fingers (not shown) extending downward from the back of the retaining block 10. Optionally, a clipping member 66 may be included in proximal location to the flange 64, thereby forming a clip that can accept and retain the upper portion of the back panel 14 of the blocks 10, 20 below.

FIGS. 11*a*–11*b* and 12*a*–12*b* depict various embodiments of top covers 68 and bottom covers 70, which are configured and adapted to securely fit over or under embodiments of the retaining wall blocks 10 of the present invention. Generally, in some embodiments, the top covers 68 and bottom covers 70 utilized in constructing some of the retaining walls of the present invention are at the very top of the wall and very bottom of the wall to at least partially seal the continuous chamber channels. However, the use of such covers 68, 70 at intermediate locations through the wall may also be performed. In various embodiments of the present invention, the top cover 68 generally includes a continuous top panel 72 that includes overlapping edges 74, which overlap securely over the outside side and back panels 14, 16. In some embodiments of the invention, the overlapping edges 74 may be present around the entire perimeter of the top panel 72. Alternately, a forward extending apron 52 may be positioned at the front of the top cover 68 and utilized to secure the cover 68 to the adjacent blocks 10, 20 below by inserting the apron 52 under the top panel 40 of said blocks 10, 20.

Figure 12A:
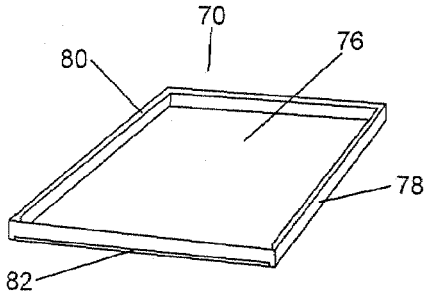
FIGS. 12*a* and 12*b* are perspective views of bottom cover embodiments used to seal a deterioration resistant retaining wall block.
Figure 12B:
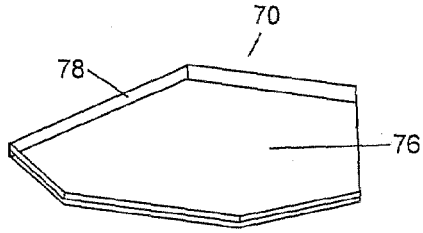
Figure 13:
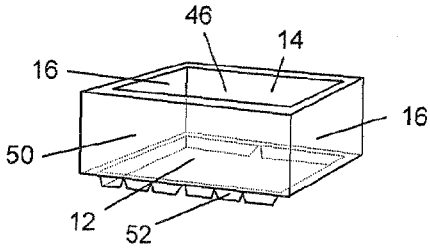
FIG. 13 is a perspective view of an embodiment of a deterioration resistant retaining wall block that includes a top cover with a planter aperture.

Embodiments of the bottom covers 70 of the present invention, as depicted in FIGS. 12*a* and 12*b*, may include a bottom panel 76 with attached bottom side walls 78 extending around the perimeter of the bottom panel 76. The side walls 78 may be configured to overlap the front, back and side panels (depicted in FIG. 12*a*) or configured to nest within the front, back and side panels 12, 14 and 16 (depicted in FIG. 12*b*). In other embodiments, as depicted in FIG. 12*a*, the overlapping sides may include an optional channel 80 for receiving and retaining the front, side and back panels 12, 14, and 16 of the adjacent block 10, 20 above. Finally, the front of the bottom cover 70 may include one or more apron apertures 82 opening to the side or bottom of the bottom cover 70 for receipt of an apron 52 from the adjacent block 10, 20 above. Alternatively, the top covers 68 and/or bottom covers 70 may include only a top panel 72 or bottom panel 76 that nest and optionally secure into place just within the front panel 12, back panel 14 and side panels 14 of the block 10, 20. Additionally, the top cover 68 may include one or more planting apertures 46 for allowing the growth of vegetation from the block. An illustration of one such embodiment is depicted in FIG. 13.

Figure 14:
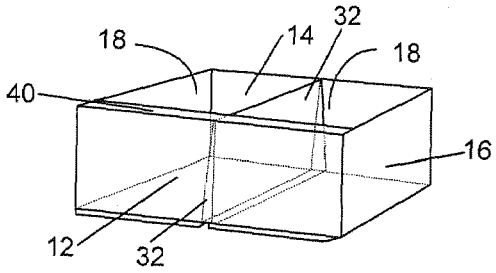
FIG. 14 depicts a perspective view of a multi-unit deterioration resistant retaining wall block.

Another embodiment of the present invention is depicted in FIG. 14. The embodiment shown in FIG. 14 comprises a deterioration resistant retaining block 10, 20 wherein more than one chamber 18 is included within the retaining block 10, 20. The multiple chambers 18 are defined by interior partitions 32 that may extend either the length and/or the width of the block 10, 20. The interior partitions 32 may also be utilized to add additional support to the retaining block 10, 32 to prevent any possible crushing or expansion of the block 10, 20. The interior partitions 32 are within the interior of the retaining block 10, 20 and are present to define separate chambers that can accommodate filling of each individual chamber 18 with appropriate fill material, such as sand, gravel, crushed rock, pea rock, soil, cement, concrete or any other suitable material.

Figure 14A:
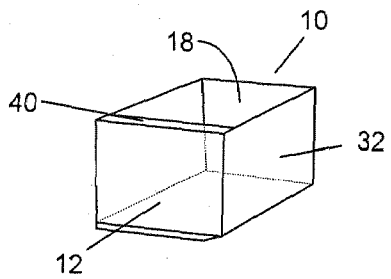
FIG. 14*a* depicts a perspective view of a single unit or partial block of a multi-unit deterioration resistant retaining wall block after division of the block.

Multiple chambers 18 also allow for the retaining block 10, 20 to be cut into various shapes or into partial blocks and still maintain a chamber 18 that can receive and retain fill materials as illustrated in FIG. 14*a*. FIG. 14*a* depicts a section of the retaining block 10, 20 as shown in FIG. 14 wherein the block 10 has been cut in half. The ability to cut the retaining block 10, 20 and still retain the same features is particularly useful in preparing ends and awkward segments of retaining walls. In one embodiment, a block 20, as depicted in FIG. 2*b*, and a front panel 12, as depicted in FIG. 8*a*, may be cut to a desired width, and adjoined with a side panel to secure the front panel 12 to the back panel 14 of the block 20 utilizing an interior securing mechanisms 22 positioned on the front panel 12 and back panel 14.

Figure 15:
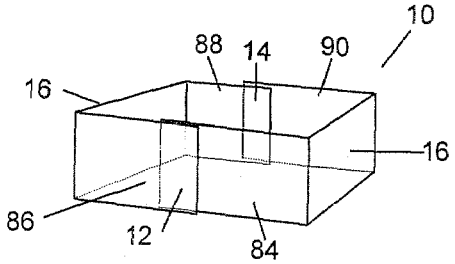
FIG. 15 depicts a perspective view of an embodiment of the present invention formed into a partial block.

In another embodiment, as depicted in FIG. 15 a partial block may be formed by cutting a retaining wall block 10, 20 and nesting the first front section 84 of the front panel 12 within the second front section 86 of the front panel 12 and nesting the second back section 88 within the first back section 90. The nested partial block sections may be adjoined using any attachment means known in the art; for example clips, tacks, rivets, adhesives, securing mechanisms as described above, or combinations thereof. It is noted that the first front section 84 and either or both back sections 88, 90 may be trimmed to properly fit when nesting. Alternate top and bottom covers (not shown) configured to conform to the various shapes of a divided retaining block 10, 20 may also be provided or formed by cutting. As previously mentioned, partial blocks may further include one or more shorter stabilizing partitions (not shown) to assist in securing the two halves of the block together after cutting and provide addition stability to the partial block.

Figure 16:
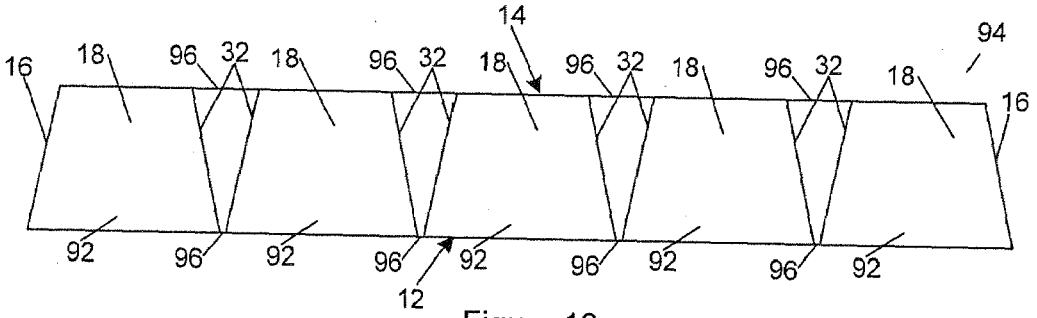
FIG. 16 depicts a top view of a multi-unit deterioration resistant retaining wall block with disengaging tabs.
Figure 16A:
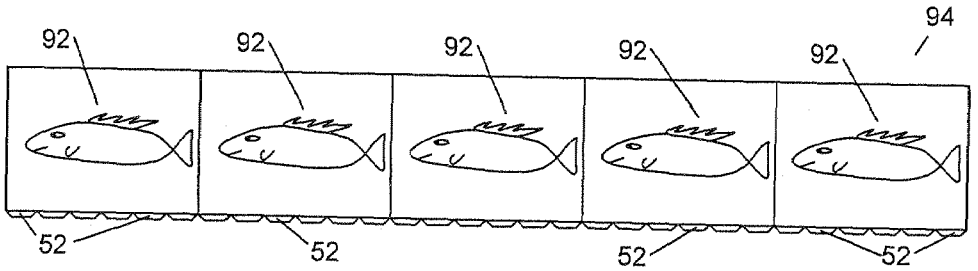
FIG. 16*a* depicts a front view of a multi-unit deterioration resistant retaining wall block.
Figure 17:
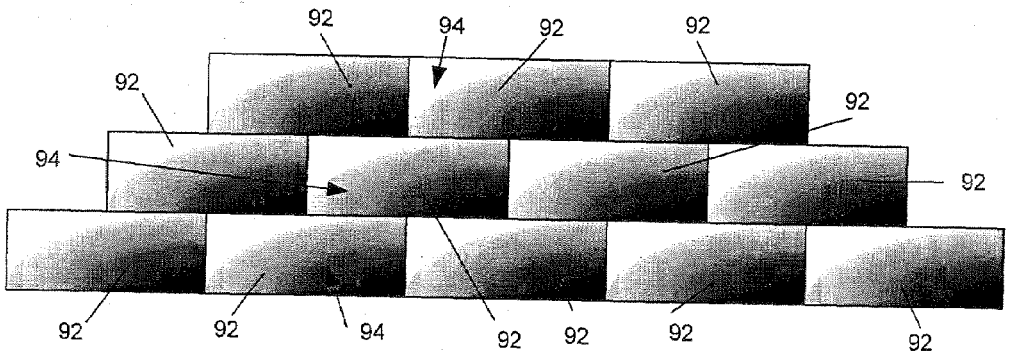
FIG. 17 depicts a front view of a deterioration resistant retaining wall constructed of multi-unit deterioration resistant block and having a colored and textured front panel.

FIG. 16 illustrates a top view of a retaining wall block wherein multiple units 92 are incorporated into a single block 94. A single multi-unit block 94 provides the appearance of multiple retaining blocks present in a single structure and generally includes a front panel 12, back panel 14 and two or more side panels 16 operably adjoined to form two or more chambers 18. A top cover (not shown) or bottom cover (not shown) may be provided for a multi-unit block 94 and may include a single sheet or multiple sheets of material which covers each unit 92. The interior of the retaining block 94 of this embodiment includes one or more interior partitions 32. FIG. 16*a* depicts the front view of the multi-unit retaining block 61, which has the appearance of multiple separate units 92. In various embodiments, the multiple multi-unit blocks 94 provide the appearance similar to the partial assembly of a retaining wall comprising a plurality of individual blocks, such as depicted in FIG. 17. The multi-unit retaining block 94 may be a unitary structure or may include multiple components, such as a multi-unit block 94 including individual top or bottom covers (not shown).

Also, as depicted in FIG. 16, the multi-unit retaining wall block 94 may have disengaging tabs 96 positioned between each individual unit 92 on the front and back of the multi-unit block 94 for disconnecting units 92 of the block 94. One example of the tabs 96 may be one or more thin sections of flexible or rigid plastic positioned between the units 92 that adjoin and separate each individual unit 92. The units 92 can be separated or pushed together in the back to curve a wall by simply cutting or removing the tab 96.

Figure 18:
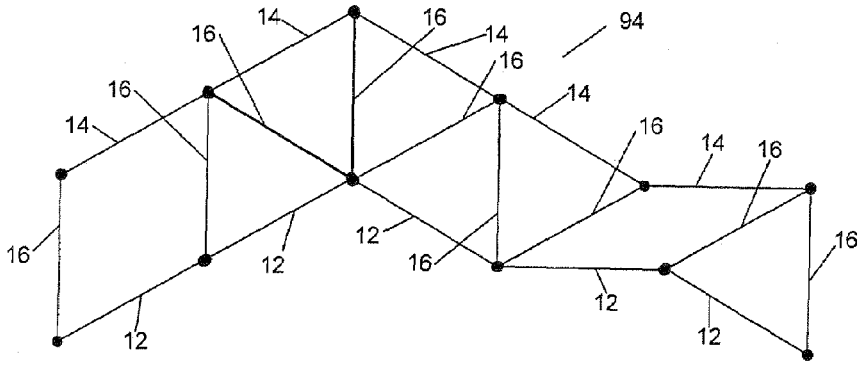
FIG. 18 depicts a top view of a multi-unit deterioration resistant retaining wall block comprising a plurality of front, side and back panels.
Figure 19:
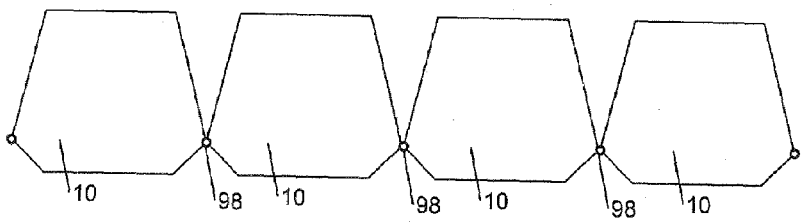
FIG. 19 depicts a top view of a deterioration resistant retaining wall row that includes a plurality of blocks that have interlocking pegs and hinges.

In an alternate embodiment of the present invention, the multi-unit block 94 may include a plurality of panels, similar to those previously described in the explanation of the panel block 20 embodiments. FIG. 18 depicts another embodiment of the multi-unit block of the present invention, wherein a plurality of front panels 12, back panels 14 and side panels have been adjoined with securing mechanisms 22 to form a multi-unit block 94.

Figure 20:
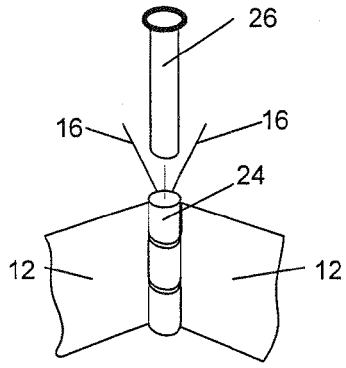
FIG. 20 depicts an exploded perspective view of the deterioration resistant retaining wall block that includes pegs and hinges.

FIGS. 19–23 depict other embodiments of the present invention wherein the block 10 or panel block 20 include an interconnecting device 98. It is noted that in the panel block 20 embodiments, the interconnecting device 98 may be a securing mechanism as described above or a variation thereof. In various embodiments, as depicted in FIG. 20 the interconnecting device 98 includes a peg and socket system having one or more insertable pegs 26 to adjoin two or more blocks by inserting the pegs 26 into threads 24 that form a socket. The sockets are generally positioned on an edge or just inside the edge of the front, side and/or back panels 12, 16, 14. The sockets may be integral to the front or back panels 12, 14 or may be secured to the panels 12, 16, 14 in any manner known in the art. The pegs 26 are configured to be securely receivable in the sockets and may be configured to swivel the block 10, 20. The insertable pegs 26 can be made of any shape and size, which can be securely fit into the sockets.

Figure 21:
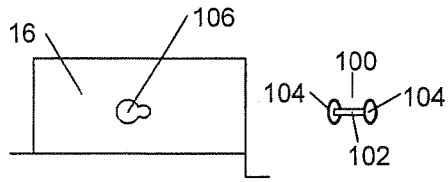
FIG. 21 depicts a side view of an embodiment of a deterioration resistant retaining wall block having an aperture for accepting an interlocking spool.

Another type of anchoring device included in the present invention may be a side locking mechanism. As depicted in FIG. 21, one or more interlocking spools 100, each comprising an elongated member 102 operably adjoined to one or more flat cylinder 104 attached to one or more ends, may adjoin adjacent side blocks 10. Each cylindrical end 104 of each spool 100 may be inserted into connecting apertures 106 positioned on the side panels 16 of adjacent blocks 10, 20 thereby securing them together.

Figure 22:
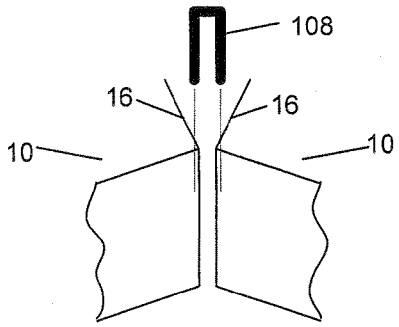
FIG. 22 depicts a perspective view of an embodiment of the deterioration resistant retaining wall block of the present invention that is secured with a clipping device.

Alternatively, in one embodiment of the present invention side by side adjacent blocks 10, 20 may be adjoined with a clipping device 108. In one embodiment the clipping device 108 my be configured in a U shape and sized to snuggly fit over the side panels 16 of two adjacent blocks. An illustration of one embodiment of a clipping device is depicted in FIG. 22.

Figure 23:
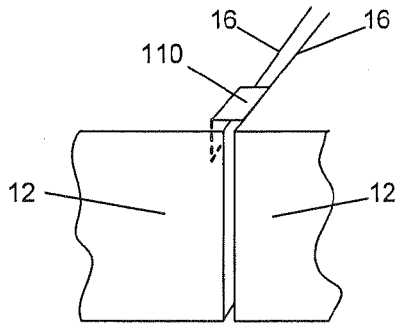
FIG. 23 depicts a perspective view of an embodiment of the deterioration resistant retaining wall block of the present invention that is secured with a integral hook.

FIG. 23 depicts an additional embodiment of the present invention, similar to hook attachments, wherein the retaining wall block 10 or panel block 20 includes an interlocking feature that comprises a hook or peg 110. An optional pocket (not shown) may also be placed in the block 10 for receiving the hook 110 from adjacent blocks 10. In such an embodiment one or more hooks or pegs 110 extend from one side panel 16 of a retaining wall block 10, 20 and may be inserted over the opposite side panel 16 of an adjacent block 10, 20. Such interlocking mechanisms provides for a overall secure retaining wall structure by reducing the amount of movement that may occur during filling with unsecured individual blocks.

Figure 24A:
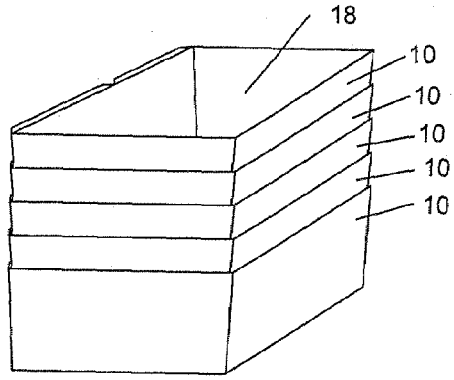
FIG. 24*a* depicts a perspective view of more than one stackable deterioration resistant retaining wall blocks in nesting positions.

Another advantage of certain embodiments of the blocks of the present invention is that they also allow for easy storage and transport due to the stackable capabilities present. FIG. 24*a* depicts a plurality of such blocks 10 in a stacked arrangement. For example, an individual block 10 may be inserted into chamber 18 of another block 10, thereby creating a stackable arrangement.

Figure 24B:
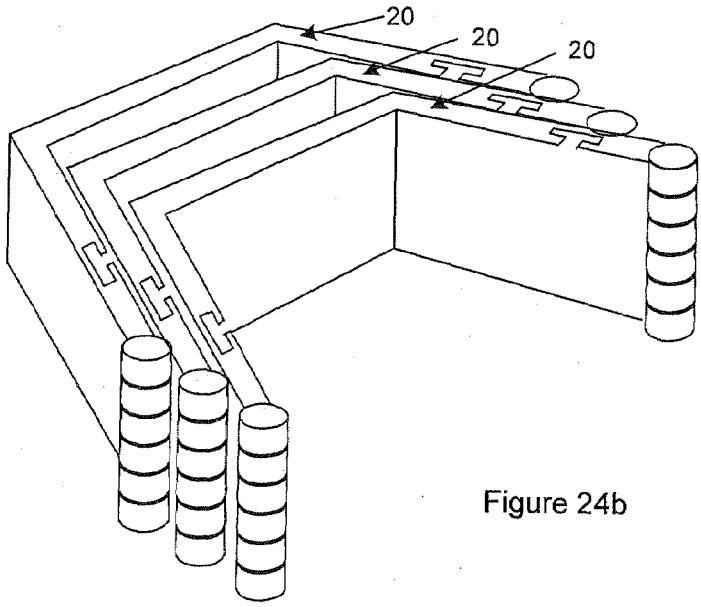
FIG. 24*b* depicts a perspective view of more than one stackable deterioration resistant retaining wall panel blocks without the front panel in nesting positions.

In other embodiments of the present invention, panel blocks are easily transported and stored by separating the front panel 12, back panels 14 and side panels 16 and stacking and/or nesting the respective panels 12, 14, 16 when in transport or storage. FIG. 24*b* depicts a plurality of panel blocks 20, as depicted in FIG. 2*b*, in a nested position.

Figure 25A:
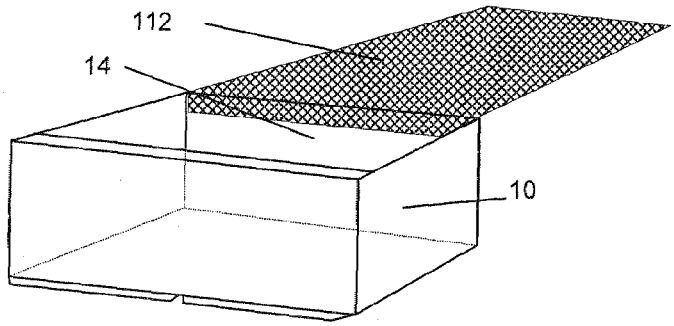
FIG. 25*a* depicts a perspective view of an embodiment of a deterioration resistant retaining wall block including a structural stabilization grid.
Figure 25B:
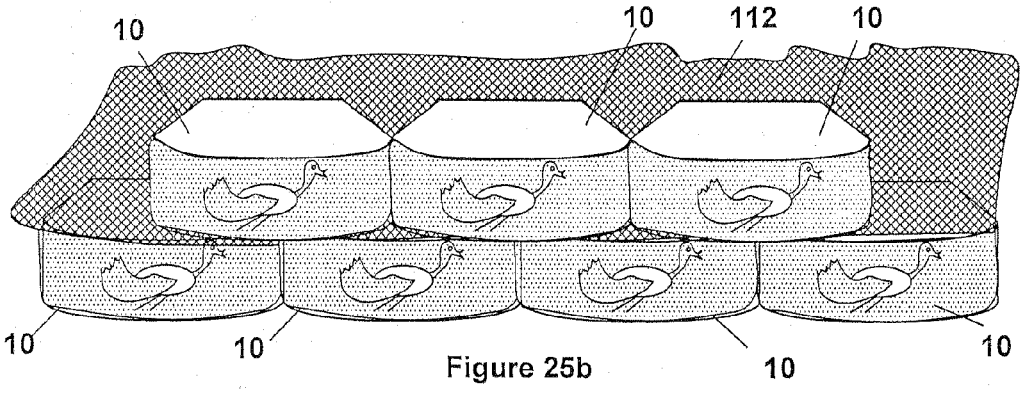
FIG. 25*b* depicts a perspective view of a deterioration resistant retaining wall including a structural stabilization grid and block having a textured and designed front panel.

The blocks 10 of the present invention may also be utilized with other wall stabilizing products to secure and stabilize a structure constructed of such blocks 10. For example, FIG. 25 depicts an embodiment of a retaining wall block 10 wherein a structural grid 112 is attached to block 10 or panel block 20 (e.g. attachment to the upper back panel 14, bottom panel (not shown or peg extensions 36 on the back panel 14 or partition 32). The grid 112 is buried behind the wall constructed of the blocks of the present invention and acts to support and stabilize the wall from moving forward away from the embankment it is protecting. FIG. 25*b* depicts an additional embodiment of the grid 112 positioned between the rows of a retaining wall that includes the block 10, 20, 94 of the present invention having a textured front panel 12 and a molded or fabricated design.

As previously mentioned, the present invention may be manufactured from a deterioration resistant, substantially rigid composite or polymeric material including, but not limited to, plastic, a rubber composition, fiberglass, or any other similar material or a combination thereof. Preferable materials comprise light-weight and slightly flexible polymers, such as high and low density polyethylene. However, other plastics may also be used. Examples of other plastics include, but are not limited to polypropylene, acrylonitrile-butadiene-styrene (ABS), poly(butylene terephthalate) (PBT), poly(cyclohexanedimethylene terephthalate) (PCT), styrene-acrylonitrile copolymers (SAN), polystyrene, polycarbonate and combinations thereof. It is also noted plastics the include filler materials, such as saw dust or paper byproducts may also be used in the present invention. Generally, the embodiments of the present invention may comprise any type of material that would have the similar characteristics to plastic, vinyl, silicone, fiberglass, rubber or a combination of these materials. It is noted that the material utilized in the present invention should be rigid enough to hold its form upon addition of filling material and also when placed in contact with other objects. Also the panels of the blocks should be substantially non-collapsible when in a filled and stacked state. Another preferable material may be comprised of a material similar to that utilized in the production of some types of garbage cans or the utilization of recycled rubber from objects such as tires. Such materials would be capable of holding rigidity and still offer flexibility when placed in contact with other objects, such as ice. Also, such materials have the ability to regain its original form when the object or material has been removed.

Embodiments of the present invention may also vary in appearance. Since embodiments of the present invention may be manufactured by a process such as injection molding, extrusion, thermo-forming, compression molding, roto-molding and the like, the molds may include any type of design or shape. Furthermore, the front panels of the retaining wall block 10 or 20 could be molded in almost any type of configuration. In one embodiment, multiple retaining wall blocks could be molded to include designs that, when positioned on a retaining wall, would complete a larger single design, such as the spelling of a company or school name in large letters or the completion of a large image. Also, since the present invention may be manufactured from a number of different products, such as plastic, a rubber composition or fiberglass, the retaining wall block may comprise any color or a multitude of colors. For example, a retaining wall installed in a beach setting may be manufactured of a plastic or rubber product and be colored in so that organic matter wash up on it would not show up as readily or may take on the appearance of sand.

As previously suggested the environment resistant retaining wall block is utilized in the construction of any type of wall or border. In application, the blocks 10 or panel blocks 20 are provided in a usable form. For the blocks 10 no additional preparation may be required. However, for the panel blocks 20, some assembly may be required. Next, a foundation is created in the area that the wall or border is to be constructed. The foundation preferably is flat and or level and can accommodate one or more retaining blocks 10. In various embodiments one or more courses of block 10, 20 may be partially submerged or totally submerged below the earth surface to provide wall stability. Once a foundation is completed, a first row is laid by positioning the blocks 10, 20, 94 in their proper position side by side and filling each retaining block 10 20, 94 with a fill material while back filling behind the block until the row is completed. A fill material packing device may be utilized while filling to ensure stability of the fill material as the wall is constructed. The chamber 18 is normally filled with materials such as sand, crushed rock, pea rock, gravel, dirt, cement, concrete or other like materials to provide weight and structure stability to the retaining wall block 10 and the entire retaining wall. The filling of the retaining wall block 10 gives it the added weight that it needs to retain its structure and hold it in place. A funneling device may be utilized, which fits securely into the openings or apertures of the retaining wall block to guide fill into the chamber of the block. The first row and subsequent rows may be straight or rounded. Upon completion of the first row, additional rows are constructed by placing the retaining wall block 10 in the proper position and performing the same filling and back filling process until a continuous retaining wall is completed. It is noted that with the continuous chamber of the present invention, multiple rows can be secured in place before filling. However, it is recommended that filling be done regularly (e.g. row by row) to ensure proper packing of the fill material. Generally, a continuous retaining wall includes stacked rows wherein individual retaining blocks are placed adjacently to one another thereby eliminating or minimizing cracks or gaps in the wall. Rows of retaining wall blocks 10 may be positioned directly over other rows of retaining wall blocks 10 wherein the blocks are positioned directly over other blocks. However, many embodiments of the present invention provide a constructed wall wherein the blocks are staggered in alternating rows. See FIGS. 7*a* and 7*b* for an illustration of a staggered retaining wall. It is noted that each retaining wall block 10, 20, 94 placed in the retaining wall is configured to retain and seal the contents of the fill material back towards the slope when the wall has been properly constructed. This may be further accomplished by applying top covers 42 and/or bottom covers 44 that at least partially seal the continuous chamber or by plant vegetation on the top row of the retaining wall. Furthermore, the retaining wall blocks 10, 20, 94 of the upper rows may be further sealed into place by an overlap of the back of retaining wall blocks 10, 20, 94 of lower rows if a retaining flange 64 or peg extensions 36 are included on the block. In the alternative or additionally, each individual retaining block 10 may be locked into position with adjacent blocks if spools 100 and apertures 106, clipping devices 108 or hooks 110 are present with the retaining block 10, 20, 94.

Figure 26:
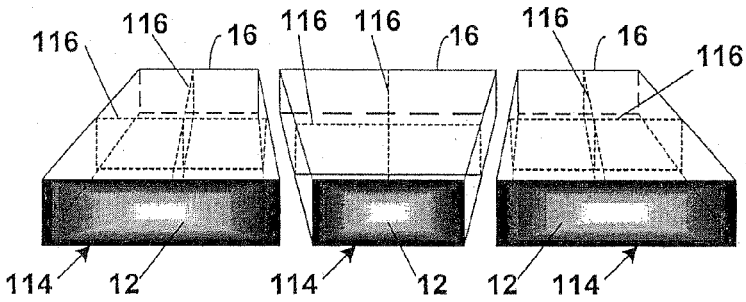
FIG. 26 depicts one embodiment of a row of capping blocks.

Upon completion of the top row of the retaining wall, a cover or capping block 114 may be placed over the top row to close and seal the continuous chamber of the retaining wall and to provide a finishing border to the top of the retaining wall. One embodiment of a capping block 114, as depicted in FIG. 26, may be polygonal in shape and include textured and designed faces on both the front panels 12 and back panels 16 of the block 114. The capping blocks 114 may further include pegs (not shown), similar to those depicted in the previous block embodiments, that may be utilized to secure the capping block to the blocks positioned below. Alternatively, the capping blocks may be secured to the blocks 10, 20, 94 below by any means known in the art, such as clips, tacks, adhesives or the like. The capping blocks 114 may be filled with a fill material, similar to the other embodiments of the present invention, or may be a simple thinner block that may include a plurality of reinforcing partitions 116 as disclosed in FIG. 26.

Embodiments of the present invention may also be used in conjunction with regular dry cement process blocks, bricks or stones, such as those produced by Keystone® or Anchor® Wall Systems. A retaining wall constructed in water or along a waterfront property may utilize the retaining wall block of the present invention at water level and below and then the regular keystone or retaining wall materials can be used on top of the retaining wall block of the present invention. The utilization of the retaining wall block of the present invention would be easy to match colors with the conventional retaining wall building materials because the materials utilized to manufacture the present invention can be colored and designed to match virtually any type of retaining wall construction material.

Furthermore, the retaining wall block may be manufactured in a multitude of different sizes, shapes and configurations. For example, an embankment or steep shoreline could support a retaining wall configured in a step like arrangement or design. Such a structure, may be utilized as a retaining wall and/or a stairway down to the beach or to the water.

While the invention has been illustrated and described in detail in the drawings and foregoing description, such an illustration and description is to be considered as exemplary and not restrictive in character, it being understood that only the preferred embodiments have been shown and described and that all changes and modifications that come within the spirit of the invention are desired to be protected.

What is claimed is:

1. A deterioration resistant retaining wall block comprising:

a front panel including a deterioration resistant composite or polymeric material and having a molded and/or fabricated front surface to provide texture and color to form an earthen appearance;

a back panel including a deterioration resistant composite or polymeric material; and one or more side panels including a deterioration resistant composite or polymeric material that are operably adjoined to one or both of the front panel and back panel to form a chamber;

one or more securing aprons operable adjoined to one or more of the front panel, back panel and side panels; and an open top surface including no top panel or a partial top panel extending from a front edge of the front panel back a length no more than 75% of the width of the block.

2. The deterioration resistant block of claim 1, wherein the front panel, back panel and side panels are adjoined with one or more securing mechanisms.

3. The deterioration resistant block of claim 1 wherein the block further includes one or more fill materials placed into the chamber of the deterioration resistant retaining wall block.

4. The deterioration resistant block of claim 1 wherein the composite or polymeric material is selected from the group consisting of polyethylene, polypropylene, Acrylonitrile-butadiene-styrene (ABS), Poly(butylene terephthalate) (PBT), Poly(cyclohexanedimethylene terephthalate) (PCT), styrene-acrylonitrile copolymers (SAN), polystyrene, polycarbonate and combinations thereof.

5. The deterioration resistant block of claim 1, wherein the block further includes more than one unit to form a multi-unit block.

6. The deterioration resistant block of claim 5 wherein the multi-unit block further includes one or more disengaging tabs.

7. The deterioration resistant block of claim 1, wherein the block further includes one or more anchoring devices selected from a group consisting of a retaining flange, pegs and locking mechanisms.

8. The deterioration resistant block of claim 1, wherein the securing mechanism is a T-hook and T-slot system or a peg and socket system.

9. The deterioration resistant block of claim 2, wherein the fill materials are selected from a group consisting of sand, gravel, dirt, crushed rock, pea rock and concrete.

10. The deterioration resistant block of claim 1, wherein the block includes one or more partitions.

11. A deterioration resistant retaining wall panel block comprising:

a front panel including a deterioration resistant composite or polymeric material and having a molded or fabricated front surface to provide the texture and color of an earthen appearance;

a back panel including a deterioration resistant composite or polymeric material;

one or more side panels including a deterioration resistant composite or polymeric material that are operably adjoined to one or both of the front panel and back panel by one or more securing mechanisms to form a chamber; and an open top surface including a partial top panel that extends from a front edge of the retaining wall panel block back a length no more than 75% of the width of the block.

12. The panel block of claim 11 further including one or more fill materials placed into the chamber of the panel block.

13. The panel block of claim 11 wherein the back panel and one or more side panels are integral and without securing mechanisms to adjoin the panels.

14. The panel block of claim 11, wherein the block further includes more than one unit to form a multi-unit panel block.

15. The panel block of claim 11, wherein the securing mechanism is a T-hook and T-slot system or a peg and socket system.

16. The panel block of claim 11, wherein the block further includes one or more partitions.

17. The panel block of claim 11, wherein the front panel includes a molded and/or fabricated front surface to provide texture and color to form an earthen appearance.

18. A method of building a deterioration resistant retaining wall comprising;

a) placing a plurality of deterioration retaining wall blocks of claim 1 in a row;

b) filling the chamber of each block in the row with one or more fill materials;

c) positioning a second row of deterioration resistant retaining wall blocks above the first row of deterioration resistant retaining wall blocks;

d) filling the second row of deterioration resistant retaining wall blocks with a fill material; and e) continuing the previously described steps until the desired number of rows is achieved.

19. A deterioration resistant retaining wall comprising a plurality of panel blocks comprising:

a front panel including a deterioration resistant composite or polymeric material and having a molded or fabricated front surface to provide the texture and color of an earthen appearance;

a back panel including a deterioration resistant composite or polymeric material; and one or more side panels including a deterioration resistant composite or polymeric material that are operably adjoined to one or both of the front panel and back panel by one or more securing mechanisms to form a chamber; and an open top surface including a partial top panel that extends from a front edge of the retaining wall panel block back a length no more than 75% of the width of the block.

* * * * *